US006729092B2

(12) United States Patent
Grosjean

(10) Patent No.: US 6,729,092 B2
(45) Date of Patent: May 4, 2004

(54) JOINT COVER

(76) Inventor: Michel Grosjean, Le Bernard 66 Route du Murier, 38400 Saint Martin d'Heres (FR)

( * ) Notice: Subject to any disclaimer, the term of this patent is extended or adjusted under 35 U.S.C. 154(b) by 0 days.

(21) Appl. No.: 09/983,638

(22) Filed: Oct. 25, 2001

(65) Prior Publication Data

US 2002/0050109 A1 May 2, 2002

(30) Foreign Application Priority Data

Nov. 2, 2000 (FR) ..... 00 14060

(51) Int. Cl.[7] ..... E04F 19/06; E04F 15/14
(52) U.S. Cl. ..... 52/395; 52/393
(58) Field of Search ..... 52/396.04, 396.1, 52/800.12, 393, 395, 402, 463, 468, 472; 403/100, 101, 292, 294, 341, 293; 29/525.02, 525.03, 525.04

(56) References Cited

U.S. PATENT DOCUMENTS

| | | | | | |
|---|---|---|---|---|---|
| 3,570,205 | A | * | 3/1971 | Payne | 52/466 |
| 3,732,659 | A | * | 5/1973 | LaBarge | 52/461 |
| 4,067,155 | A | * | 1/1978 | Ruff et al. | 52/105 |
| 4,385,850 | A | * | 5/1983 | Bobath | 403/205 |
| 5,155,952 | A | * | 10/1992 | Herwegh et al. | 52/100 |
| 6,102,407 | A | * | 8/2000 | Moriya et al. | 277/316 |
| 6,230,385 | B1 | * | 5/2001 | Nelson | 29/450 |
| 6,340,264 | B1 | * | 1/2002 | Nelson | 403/297 |
| 6,345,480 | B1 | * | 2/2002 | Kemper et al. | 52/395 |

FOREIGN PATENT DOCUMENTS

| | | | | |
|---|---|---|---|---|
| DE | 295 08 050 U1 | | 9/1996 | |
| DE | 299 19 138 U1 | | 12/1999 | |
| DE | 19951516 A1 | * | 6/2001 | E04F/15/14 |
| EP | 1 020 590 A | | 7/2000 | |

* cited by examiner

*Primary Examiner*—Lanna Mai
*Assistant Examiner*—John Fitzgerald
(74) *Attorney, Agent, or Firm*—Oliff & Berridge, PLC

(57) ABSTRACT

The invention relates to a joint cover comprising a base section to be fixed onto a support; a covering section; and one or more intermediate parts designed to receive the covering section by clipping, the intermediate part or parts defining a cavity for receiving a head of a longitudinal tab that the covering section comprises, and comprising on each side of a plane passing through an opening for access to the cavity, at least one external rib able to co-operate, by clipping of opposite shapes, with means of a longitudinal gully of the base section, and at least one internal tab for retaining said head in the intermediate part.

8 Claims, 3 Drawing Sheets

JOINT COVER

BACKGROUND OF THE INVENTION

The present invention relates to joint covers or threshold cover strips designed to hide the joints between floor or wall elements. The invention relates more particularly to a joint cover having a covering section that fixes onto a base section by clipping.

STATE OF THE ART

Numerous threshold cover strips comprise a covering section that is fixed by engaging on a base section by means of a system of complementary ribs, for example of the "pine-tail" type. Such systems are mostly irreversible, i.e. if the threshold cover strip is to be removed, the covering section has to be torn off damaging the complementary grooves which makes them unusable for subsequent use. Sometimes the base section is deformable. In this case, the elastic limit of the material that constitutes it (generally aluminium) is quickly reached, which prevents re-use.

Furthermore, the floor is rarely smooth. The covering section may consequently not be depressed to the same depth at the two ends of the threshold cover strip. The ribs of the covering section then cross the complementary grooves of the base section. The holding strength of the covering section is thereby considerably reduced.

To overcome these drawbacks, it has already been proposed to insert plastic intermediate parts between the base and covering sections to periodically jam the two sections. The intermediate parts are pre-positioned on the base section. An example of such a solution is described in the European Patent application 0,997,592 filed by the applicant.

A problem that remains with respect to this conventional solution is that the intermediate parts do not provide optimum lateral holding of the covering section. In particular this solution is unsuitable for step nosings.

The document DE-U-299 19 138 describes an assembly with intermediate parts wherein the intermediate parts are engaged in a longitudinal gully of the base section, a gully of the covering section being fitted onto a head of the parts or vice-versa. Such intermediate parts do not enable the covering section to be inserted in the base section which is detrimental to the vertical dimensions of the assembly and prevents fitting thereof for coverings of small thickness. Moreover, these parts do not allow any cooperation between the intermediate part and the covering section so that a traction on the latter increases the holding strength.

The document EP-A-1,020,590 describes another assembly with intermediate parts wherein the intermediate parts are engaged in a longitudinal gully of the base section, a gully of the covering section being fitted onto a head of the parts. Such intermediate parts can not be clipped onto the covering section but have to be engaged in its gully from the end of the latter, which is detrimental to ease of fitting. Moreover, as for the previous document, there is no insertion of the covering section in the base section, nor any co-operation between the intermediate part and the covering section so that a traction on the latter increases the holding strength.

The document DE-U-295 08 050 describes a finishing bead assembly system by means of intermediate parts between a gully of a base section and a head of a covering section, wherein U-shaped intermediate parts are engaged in the gully resting on the bottom thereof and receive the head of the covering section. Such intermediate parts do not enable the incline of the covering section to be adjusted. In addition, they do not enable height adjustment of the intermediate parts in the base section or fitting by pre-positioning of the parts on the covering section.

OBJECT OF THE INVENTION

The object of the present invention is to propose a new joint cover or threshold cover strip system that overcomes at least one drawback of known systems. In particular, the object of the invention is to propose an intermediate part that enables adjustment of the incline of the covering section with respect to the base section without being detrimental to the mechanical strength (lateral stress resistance).

The object of the invention is also to propose a solution that provides a good holding strength while enabling disassembly without damaging the sections.

The object of the invention is also to propose a solution that adjusts automatically to the height of the covering.

The object of the invention is also to facilitate fitting of the joint cover and in particular to enable pre-positioning of the intermediate parts on the covering section.

To achieve these and other objectives, the present invention provides a joint cover comprising:

a base section to be fixed onto a support;

a covering section; and one or more intermediate parts shorter than the length of the joint cover and designed to receive the covering section by clipping;

the intermediate part defining a cavity for receiving a head of a longitudinal tab that the covering section comprises, and comprising on each side of a plane passing through an opening for access to the cavity, at least one external rib able to co-operate, by clipping of opposite shapes, with means of a longitudinal gully of the base section, and at least one internal tab for retaining said head in the intermediate part, the depth of the gully being greater than the height of the intermediate part to enable the height of the joint cover to be adjusted.

According to an embodiment of the present invention, said gully comprises longitudinal grooves in two facing walls, the intermediate part comprising at least two external ribs designed to operate in conjunction with said grooves, the transverse cross-section of the grooves of the gully being adjusted to the transverse cross-section of the external ribs of the intermediate part.

According to an embodiment of the present invention, the number of grooves of the gully of the base section is chosen according to a required adjustment range for the distance between the base section and the covering section, the two walls of the gully being parallel over a depth at least equal to the required adjustment range.

According to an embodiment of the present invention, the longitudinal tab of the covering section presents, in transverse cross-section, a pine-tail shape with a head provided with at least two double-teeth and a preferably straight part for joining to a covering portion.

The invention also provides a fixing part of a covering section comprising a tab for clipping into said part on a base section comprising a gully for receiving said part, said part defining a cavity and comprising, on each side of a plane passing through an opening for access to the cavity, at least one and preferably at least two external ribs and at least one internal tab.

According to an embodiment of the present invention, the part presents a plane of symmetry passing through the opening and, salient from each of the two approximately facing internal faces, at least one partial closing tab of the internal cavity and a rib less salient than the tab.

According to an embodiment of the present invention, the part comprises at least two ribs salient from each of the two opposite external faces.

According to an embodiment of the present invention, the part comprises a flexibilizing indentation opposite the opening of the cavity.

According to an embodiment of the present invention, the part is made of plastic material of a hardness comprised, according to the AST MD 85 method, between 104 and 120 shore D.

BRIEF DESCRIPTION OF THE DRAWINGS

These objects, features and advantages, as well as others of the present invention will be described in detail in the following description of particular embodiments given as non-restrictive examples in relation with the accompanying drawings in which.

DETAILED DESCRIPTION OF PREFERRED EMBODIMENTS

The same elements have been designated by the same references in the different figures. For reasons of clarity and in arbitrary manner, the main direction of a section will be designated by longitudinal, the transverse direction thereof will be designated by lateral, and the direction perpendicular to the plane of the support (floor or wall covering) of the joint cover will be designated by vertical. Likewise the faces or parts of the sections that are directed towards an element of another section or that are facing the latter will be arbitrarily called internal, and the faces or parts that are directed towards the outside of the joint cover will be arbitrarily called external. Furthermore, the top and bottom of the elements will be referred to in a horizontal representation (placed on the floor) of the joint cover.

Figure 1:
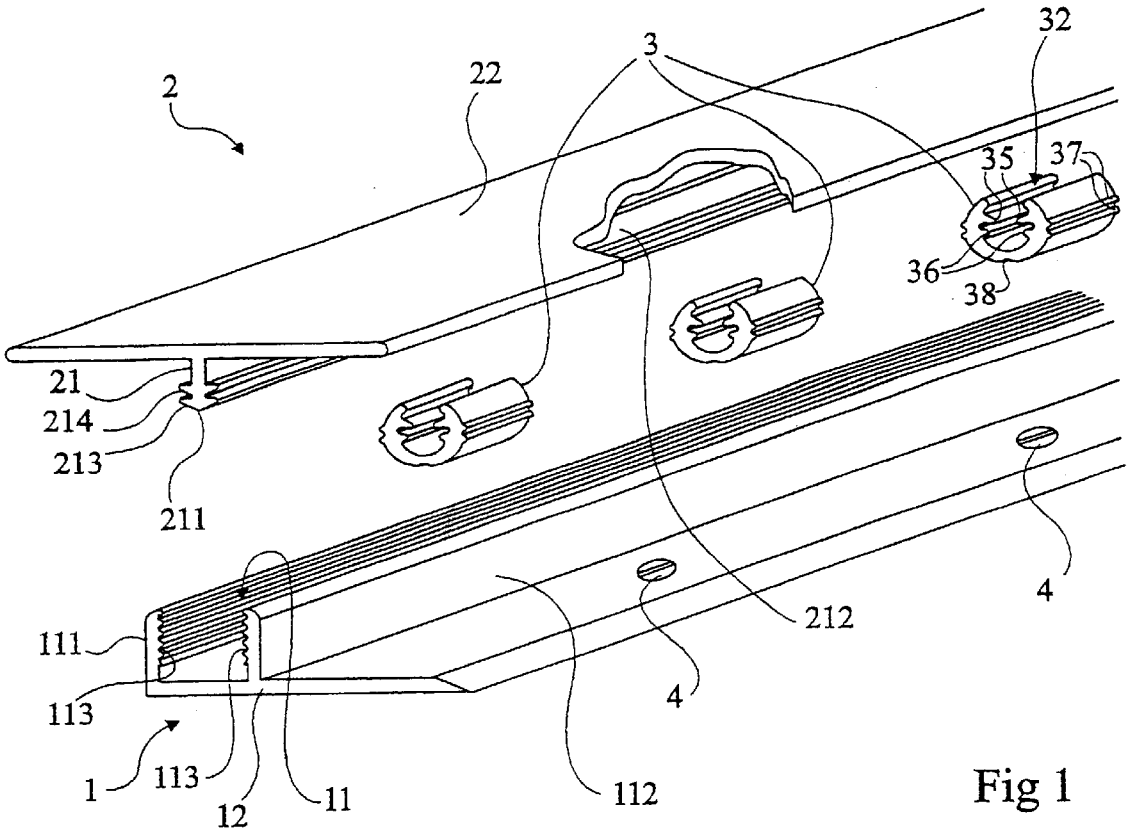
FIG. 1 is a perspective view of an embodiment of a threshold cover strip or joint cover according the invention.

FIG. 1 represents, in a partially cutaway perspective view, an embodiment of a joint cover or threshold cover strip according to the present invention. This joint cover is formed by a base section 1 designed to be fixed onto a support, generally a floor or a wall, a covering section 2 designed to be fitted onto the base section 1 to mask at least an edge of a floor or wall covering (not represented in FIG. 1), and at least one intermediate fixing part 3. According to the invention, each part 3 is designed to clip around a head 211 of an internal longitudinal tab 21 of the covering section 2 and then to clip into an internal longitudinal gully 11 of the base section 1.

One feature of the invention is to provide intermediate parts 3 made of hard plastic having the function of achieving rigid fixing of the covering section 2 in the base section 1, while having the advantage of a certain flexibility for fitting of the elements due to the shape of the part. According to the invention, the intermediate part or parts are chosen in a sufficiently hard material so as not to be crushed under the pressure applied on the covering section 2 during assembly and use.

Thus, unlike a rubber or soft plastic part which would jam the tab 21 of the covering section 2 in the gully 11 of the base section 1 by crushing or compression of this part, the invention provides a rigid fixing. One advantage is that the clearance in the assembly due to the deformation capacity of the rubber is eliminated, while maintaining a clearance inside the intermediate part, as will be seen further on. This clearance enables the covering section, when walked on, to subside and to come back up again without the fixing and the orientation of the covering section suffering therefrom. According to the invention, the clearance is vertical and lateral.

The base section 1 of a joint cover of the invention comprises a base part 12, approximately flat and designed to rest on the floor or wall (not represented). The base part 12 is fixed to the support by conventional techniques, for example by means of screws 4 passing therethrough. The gully 11 is salient towards the inside of the base part 12 (towards the section 2). It is defined by two approximately and preferably vertical (perpendicular to the plane of the base part 12) longitudinal walls 111 and 112.

In the example represented, one of the walls (wall 111) is placed at a lateral end of the base part 12. This enables a standard base to be achieved in conventional manner, whether the joint cover is placed on the stopping edge of a single covering or on a joint between two identical or different coverings. As a variant, the base part 12 can however protrude laterally on each side of the gully 11. In conventional manner, the gully 11 is preferably of smaller width than that of the base part 12 to improve the holding of the base section 1 and enable the latter to be screwed outside the gully.

The covering section 2 of a joint cover of the invention comprises a covering portion 22 overlapping the covering (s), and the approximately and preferably vertical, individual tab 21. In the example of FIG. 1, the portion 22 is flat and horizontal, the tab 21 being perpendicular to the portion 22. The tab 21 comprises a straight part 212 joining the head 211 to the internal face of the portion 22. The shape and size of the portion 22 depend essentially on the type of covering(s) the edge or edges whereof the covering section has to cover. The head 211 of a covering section of the invention is in the form of a "pine-tail" or equivalent, and comprises at least two teeth on each side of the part 212 defining a plane of symmetry of the tab 21. Two end teeth define what will be called a first double-tooth 213. The next two teeth form a second double-tooth 214.

The intermediate parts 3 designed to assemble the covering section 2 onto the base section 1 are sections preferably having a regular transverse cross-section over at least almost the whole of their length. They are for example sections cut from a longer section of plastic material. The length of the parts 3 is relatively small (for example comprised between 1 and 5 cm) compared with the usual minimum length of the joint cover (generally greater than 50 cm).

Figure 2:
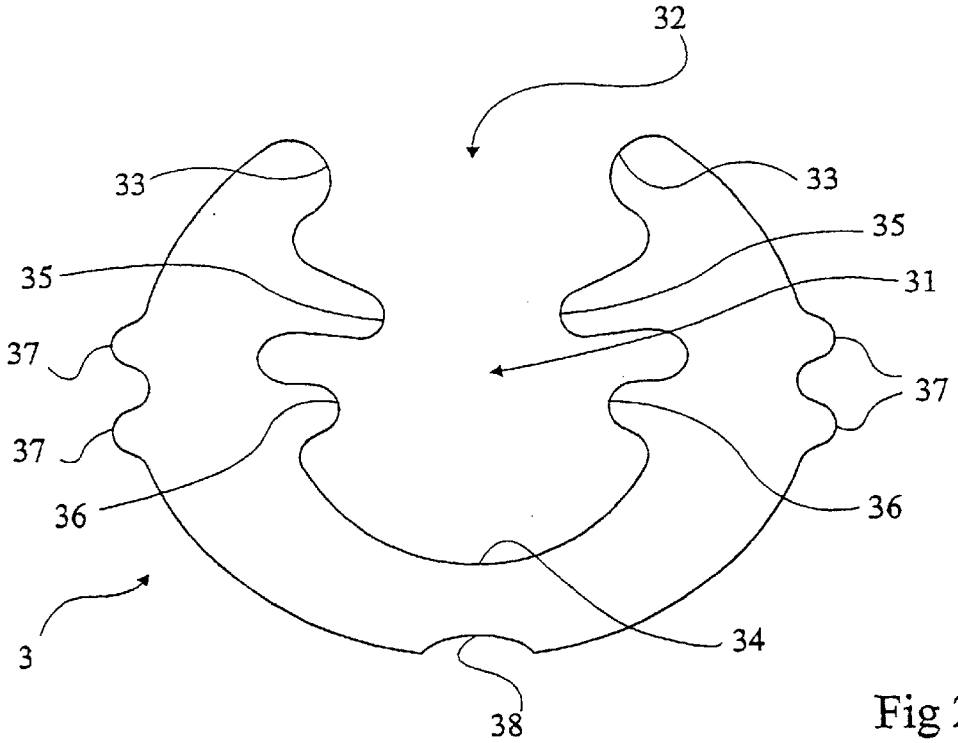
FIG. 2 is a cross-section view of an intermediate part according to a preferred embodiment of the invention.

A preferred embodiment of an intermediate part 3 according to the invention will be described hereafter in relation to FIG. 2 that represents its transverse cross-section and to FIGS. 3A to 3D that illustrate, in partial cross-section views, assembly of a joint cover according to the invention.

In the example of the figures, the part 3 has a general shape of a hollow cylinder defining a cavity 31 for receiving the head 211 of the tab 21 of the covering section 2. In addition, like the tab 21, it presents a vertical plane of symmetry. The part 3 comprises, in its upper part, an opening 32 for engagement of the tab 21 via its head 211. The opening 32 is limited by edges or tabs 33. Starting from the opening 32 and going downwards towards the bottom 34 of the cavity 31, the inside comprises, on each side, an approximately horizontal, partial closing tab 35, followed by a rib or tab 36. The edges 33, tabs 35 and ribs 36 are salient inwards, the tabs 35 being more salient than the ribs 36. On the outside, the part 3 presents, in its widest part (at about mid-height in the case of an approximately circular cross-section), and on each side, at least one outward salient rib or notch 37 (preferably two). The notches 37 or equivalent are designed to operate in conjunction with grooves 113 (FIG. 2) of opposite shapes arranged in the internal faces of the walls 111 and 112 of the gully 11 of the base section 1. At its bottom, the part 3 comprises an external indentation 38.

When assembly is performed, the part 3 is first (FIG. 3A) engaged on the head 211 of the tab 21. This engagement consists in making the end double-tooth 213 pass the edges 33. The edges 33 or equivalent have a function of holding the head 211 temporarily during fitting, the distance between the two edges being slightly smaller than the width of the double-tooth 213.

Figure 3A:
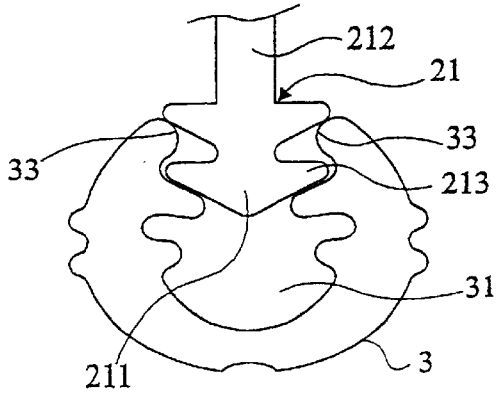
FIGS. 3A to 3D illustrate, by partial cross-section views, a fitting mode of a covering section on a base section by means of an intermediate part according to the invention.
Figure 3B:
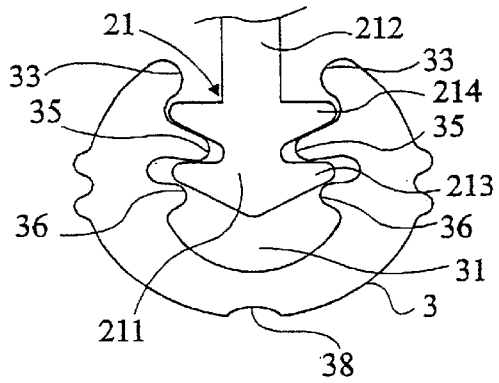
Figure 3C:
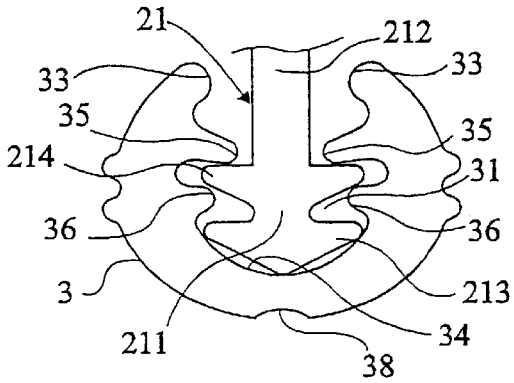
Figure 3D:
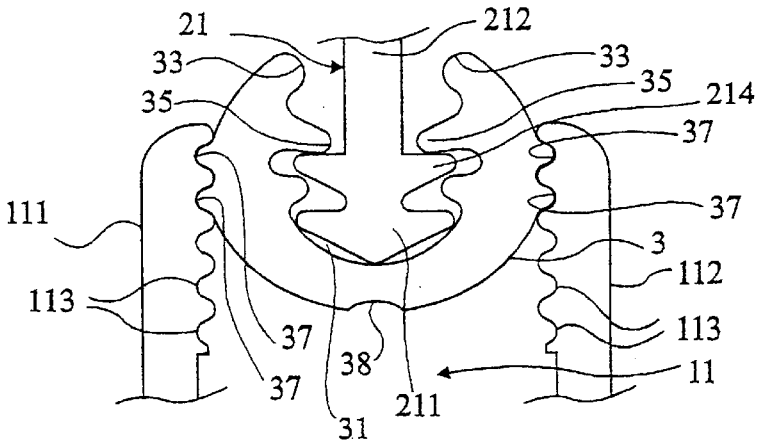

A stronger pressure of the part 3 is then exerted on the section 2 (FIGS. 3B and 3C). The lateral flexibility due to the shape of the part and enhanced by the localized weakness (indentation 38) of the bottom of the part 3 enables the latter to be "opened up" allowing the double-tooth 213 to pass (FIG. 3B) through the narrow part formed by the closing tabs 35. The length of the tabs 35 gives them a certain flexibility and elasticity facilitating this passage. The double-tooth 214 is then located between the edges 33 and the tabs 35. Penetration continues (FIG. 3C) until the end double-tooth 213 is located between the ribs 36 and the bottom 34 of the cavity 31. The double-tooth 214 is then located between the tabs 35 and the ribs 36. The part 3 is then pre-positioned with respect to the covering section. It can be considered that the tabs 35 or equivalent have the role of retaining the head 211 inside the part 3 whereas the ribs 36 or equivalent have the role of blocking the position of the head 211.

After all the parts 3 have been pre-positioned, the assembly is placed on the gully 11 (FIG. 3D) of the base section. The base section is assumed to have been fixed to the support beforehand. Centering is achieved automatically by the external shape (circular or with cut corners) of the bottom of the parts 3. Insertion of each part 3 and clipping thereof into the gully 11 are performed by force. The slight clearance of the head 211 in the cavity 31 (in particular of the double-tooth 214 between the tabs 35 and ribs 36), combined with the lateral flexibility enhanced by the indentation 38, means that the part 3 can close up slightly to facilitate passing of the grooves 113 via the notches 37. Any risk of damageable separation of the walls 111 and 112 of the gully 11 is thus prevented which avoids having to overdimension their thickness for mechanical strength reasons.

The parts 3 may present, at one of their respective longitudinal ends, at least one pin or equivalent having the role of limiting, without however preventing by manual force, sliding of the parts on the covering section and thus of facilitating fitting thereof.

The depression of the assembly formed by the covering section and intermediate parts depends on the height of the covering or coverings. The height of the joint cover adjusts automatically. Moreover, as the intermediate parts are of relatively small lengths, the discontinuity obtained in the length of the joint cover enables automatic adjustment to the height variations over the length of the joint cover. The number of grooves 113 of the base section 1, that is greater than the number of external notches or ribs 37 of the intermediate parts 3, participates in this adjustment.

The number of notches 37 depends on their cross-section and on the required adjustment of the engagement depth of the part 3 in the gully 11. For a given notch cross-section, the more the number of notches 37 increases, the more the height of the part 3 increases and the less the depth is adjustable for a given depth of gully 11. Preferably the height of the part 3 corresponds to about half the depth of the gully 11.

The number of double-teeth of the head 211 and the size thereof depend on the internal shape of the parts 3. More precisely, the height of the tabs 35 and ribs 36 and the vertical distance between the latter depends on the height of the double-teeth 213 and 214 and on the vertical distance between the latter. Preferably, the head 211 is inscribed, in cross-section, in a rectangle whose height remains smaller than its width. This, with the difference of length (in cross-section in the horizontal direction) between the tabs 35 and ribs 36, enhances the possibility of adjusting the orientation in the cavity 31. The width of the cavity 31 between the tabs 35 and ribs 36 is slightly greater than the width of the double-teeth 213 and 214. Likewise, the dimensions of the cavity 31 under the ribs 36 are adjusted so that the end double-tooth 213 engages therein with a small clearance.

Figure 4:
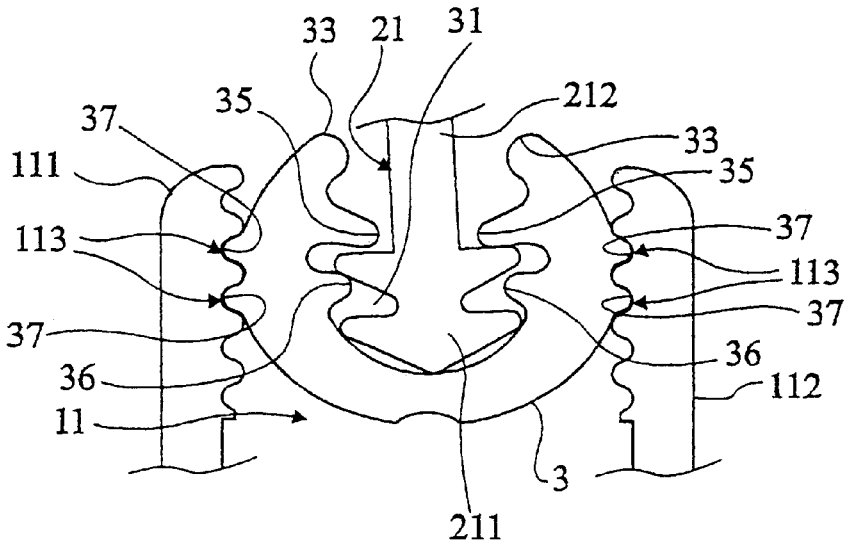
FIGS. 4 and 5 illustrate, by partial cross-section views, two examples of final positions of an intermediate part according to the invention with respect to a base section and a covering section that it assembles.
Figure 5:
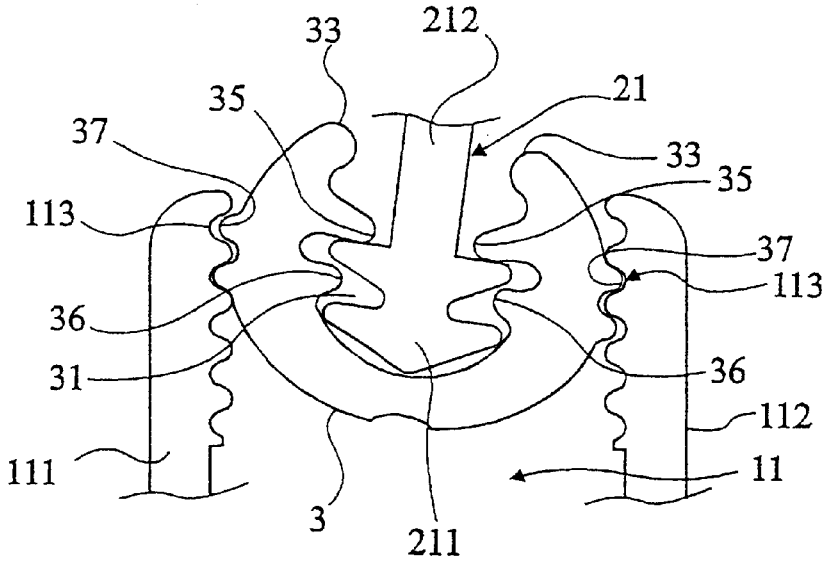

FIGS. 4 and 5 represent, in partial cross-section views, two examples of respective final positions of the elements of a joint cover according to the invention.

In the example of FIG. 4, the part 3 is horizontal in the gully 11, i.e. the notches 37 are engaged in grooves 113 of the same level. A small clearance of the head 211 in the cavity 31 and the flexibility of the tabs 35 enable automatic adjustment of the horizontal position of the covering section. This adjustment is however limited to a slight incline (a few degrees at the most).

If a larger incline is required, this is achieved by the base-part link and no longer by the part-covering link. As illustrated by FIG. 5, when the assembly formed by the covering section and intermediate parts is pressed into the gully 11, the part 3 is not horizontal. Notches 37 of the same level then clip into grooves 113 of different levels.

Preferably, the cross-section of the tabs 35, ribs 36, edges 34 and notches 37 of the part 3 is approximately circular at the free ends. As a variant, other cross-sections (pointed, square, etc.) can be used. However, a circular cross-section presents advantages in terms of ease of insertion of the tab 21 of the covering section and of rotation for adjustment of the incline.

As a particular embodiment, for a gully 11 having a width (between two bottoms of facing grooves 113) of about 6.5 mm, a part 3 is fitted having a maximum total width (between the two free ends of two horizontally aligned notches 37) of about 6.5 mm and a height of about 5.5 mm. The head 211 then preferably has a width of about 3 mm for a height of about 2 mm (1 mm per double-tooth). The gully 11 can be of a depth (height) comprised for example between 7 and 20 mm.

When upwards traction of the covering section of a fitted joint cover of the assembly takes place, the double-tooth 214 tends to move the tabs 35, which generates a lateral pressure of the walls of the gully and enhances clamping inside the base section 1. The joint cover of the invention can however be disassembled without any risk of damaging the base and covering sections. Above a certain vertical traction force, the tabs 35 in fact twist upwards and successively release the double-tooth 214 and then the double-tooth 213. The covering section is therefore extracted from the intermediate parts which remain in the base section 1. As a variant, a rotation of the covering section with respect to the base section is forced by means for example of a blade engaged between the covering and the covering section. The holding strength of the covering section depends essentially on the number of intermediate parts for a given section length and on the length of these parts. To extract the intermediate parts 3 one by one from the base section 1 (which is necessary to be able to re-use the base section), the two sides of each part 3 are moved towards one another, for example by means of a blade moving the edges 33 towards one another until the notches 37 are released from the grooves 113, the indentation 38 allowing deformation to take place. At the worst, in case of careless disassembly, the intermediate parts 3 are lost and have to be replaced for a new assembly.

One advantage of the invention is that it enables easy fitting of a covering section on a base section. In particular, the invention enables pre-positioning of the intermediate elements on the covering section.

Another advantage of the invention is that having recourse to an intermediate part of suitable shape enables the manufacturing tolerances of the base and covering sections to be compensated. These sections are in fact often made of aluminium and having recourse to a plastic intermediate part (for example made of PVC, polyamide, etc.) reduces the clearance between the parts.

Another advantage of the invention is that this clearance is minimized by the hardness of the intermediate part. According to the AST MD 85 method, this hardness is comprised between 104 and 120 shore D.

Another advantage of the invention in its preferred embodiment where the number of grooves 113 of the base section is larger than the number of external notches or ribs 37 of the intermediate part is that, whatever the depth of depression of the intermediate part, as soon as all the notches 37 are engaged in grooves 113 of the base section, its mechanical strength in the base section (holding strength) is constant.

The invention is suitable for series fabrication enabling standardization of a maximum of elements. In particular, the heads 211 of the covering sections, the intermediate parts 3 and the width of the gullies 11 of the base sections and their respective grooves 113, and even the complete base sections, can be standard. The heights of the tabs 21 of the covering sections and the shape of the covering portions 22 are on the other hand adjusted to the covering(s). In this respect, the invention is also suitable for step nosings.

In the case of coverings having a certain vertical elasticity (for example achieved by a layer of foam for a stratified flooring or due to its nature and thickness for a carpet), the invention takes advantage of this elasticity to improve securing or anchoring of the covering section. Indeed, when the latter is pressed into the base, the pressure exerted tends to compress the coverings. When this pressure is released, the coverings exert a vertical pressure that is converted into lateral pressure by the part 3, improving jamming in the gully 11.

The present invention naturally extends to various alternative versions and modifications that will be clearly apparent to the man of the art. In particular, the dimensions given for example purposes can be modified according to the application from the functional indications given above.

In particular, in a simplified embodiment, a single tab can be provided in the intermediate part salient from each of the two internal faces thereof, this tab even being able to be the same as the tab called the temporary holding tab provided that it has a possibility of lateral movement in the base section. Furthermore, although having recourse to two external ribs on each side of the part constitutes a preferred embodiment, a single one of these ribs could be provided on each side of the part.

Moreover, other shapes than the cylinder can be envisaged for the general shape of the intermediate parts. The latter could for example have a general U-shaped cross-section. However, an approximately circular cross-section presents advantages in terms of rotation. This also enables a minimum distance between the free end of the head 211 and the bottom 34 of the part 3 to be respected more easily, which participates in minimizing the height of the part 3 and therefore optimizes the height adjustment possibilities of the joint cover. This moreover facilitates the jamming effect of the part in the base by separation of its tabs.

Finally, for implementation of the invention, the walls 111 and 112 of the base section 1 are not necessarily vertical. They must however be parallel to one another at least over the part provided with the grooves 113 acting as height adjustment means. Along the same lines, the depth of the gully can be smaller than the height of the base section provided that it remains greater than the height of the intermediate pats to keep a possibility of height adjustment by the depression depth in the base section.

What is claimed is:

1. A joint cover, comprising:

a base section to be fixed onto a support means, and having a longitudinal gully with two facing walls, each including a number of grooves extending parallel to each other in a longitudinal direction;

a covering section comprising a longitudinal tab provided with a head, the head having at least one double-tooth, and a rectilinear part for joining the head to the covering section;

at least one intermediate piece of plastic material, having a cavity which is inserted by clipping on the head of the covering section, the intermediate piece being shorter than the length of the cover joint, wherein each internal face of the intermediate piece has a closing tab inserted between a corresponding edge, and an inner blocking rib which is less protruding than the closing tab, the intermediate piece has one external rib cooperating with the grooves of the gully, the gully having a depth which is greater than a height of the intermediate piece so that a distance between the covering section and the base section may be adjusted in height, and the width of the cavity arranged between the closing tabs and the inner blocking ribs being slightly greater than the width of the double-teeth of the head, so as to form a clearance allowing deformation by lateral flexibility of the intermediate piece to facilitate passing of the grooves upon insertion in the gully, to adjust the orientation of the head in the cavity, and to adjust the orientation of the intermediate piece in the gulley.

2. The joint cover according to claim 1, wherein the two walls of the gully in the base section are parallel over a depth at least equal to an adjustment range along the distance between the covering section and the base section.

3. The joint cover according to claim 1, wherein the longitudinal tab has a pine-tree shaped end in transverse cross-section.

4. The joint cover according to claim 1, wherein the intermediate piece includes an opening for engagement of the longitudinal tab, the opening having the corresponding edges for temporarily holding said head during fitting before total introduction in the cavity, a distance between the two edges being slightly smaller than a width of the double-teeth of the head.

5. The joint cover according to claim 1, wherein the intermediate piece of plastic material has a hardness between 104 and 120 shore D.

6. A joint cover according to claim 1, wherein the at least one intermediate piece is a fixing part of the covering section.

7. A joint cover according to claim 3, wherein the head of the longitudinal tab comprises two double-teeth for receiving the intermediate piece.

8. The joint cover according to claim 4, wherein the intermediate piece further comprises an indentation located opposite to the opening, so as to allow additional elasticity upon moving from groove to groove in the gully.

* * * * *